US005433663A

United States Patent [19]

Henningsson et al.

[11] Patent Number: 5,433,663

[45] Date of Patent: Jul. 18, 1995

[54] INSECT-NET

[75] Inventors: Göran Henningsson; Olov Holmlid, both of Kinna, Sweden

[73] Assignee: Ludvig Svensson International B.V., Hellevoetsluis, Netherlands

[21] Appl. No.: 193,031

[22] PCT Filed: Aug. 4, 1992

[86] PCT No.: PCT/SE92/00534

§ 371 Date: Feb. 4, 1994

§ 102(e) Date: Feb. 4, 1994

[87] PCT Pub. No.: WO93/03214

PCT Pub. Date: Feb. 18, 1993

[30] Foreign Application Priority Data

Aug. 5, 1991 [SE] Sweden ..... 9102285

[51] Int. Cl.[6] ..... F24F 7/02

[52] U.S. Cl. ..... 454/358; 55/422; 454/364

[58] Field of Search ..... 454/250, 358, 364, 158; 55/422, 506; 160/370, 377, 400

[56] References Cited

U.S. PATENT DOCUMENTS

| | | | |
|---|---|---|---|
| 926,042 | 6/1909 | Zeitschner | 454/358 X |
| 1,858,977 | 5/1932 | Zech | 454/158 X |
| 2,228,935 | 1/1941 | von Roeder | 454/364 |
| 4,411,722 | 10/1983 | Yazawa et al. . | |
| 4,587,997 | 5/1986 | Brooks . | |

FOREIGN PATENT DOCUMENTS 2178765 2/1987 United Kingdom .

*Primary Examiner*—Harold Joyce

*Attorney, Agent, or Firm*—Mathews, Woodbridge & Collins

[57] ABSTRACT

An insect net for screening off at least one air passage which can be opened and closed in variable degree by a shutter. The net is produced from fabric, which is drapeable to a variable extent in dependence of the opening degree of the shutter. In the warp and/or weft direction of the fabric at some distance from each other are inlaid control threads, which are provided at equal intervals to form loops for receiving the control bars of the shutter.

12 Claims, 3 Drawing Sheets

INSECT-NET

The present invention refers to an insect-net for screening off at least one air passage by means of a shutter which can be opened and shut in variable degree, and which net is produced from a fabric, as is drapeable to a variable extent depending on the opening degree of the shutter, and which net is deformation resistant against dislocation of the crossing thread system of the fabric.

THE BACKGROUND OF THE INVENTION

Conventional insect-nets consist either of metal wires and are then used exclusively mounted onto a frame, or else of textile threads and which are used mainly as so called mosquito nets, i.e. one hangs the net above a rack or the like. The net is not subjected to mechanical strain and a relatively loose binding technique holds the individual threads in place.

The desire to reduce the use of and to a certain extent even the prohibition against using chemical insecticides within the greenhouse industry has entailed so that the demand of locking out of harmful bugs has become a reality. Instead of chemical insecticides one has begun to use combating insects and for the pollination in the greenhouse bumble-bees, bees and the like, whose presence consequently is desirable and which represent a now negligible value so that their escape from the greenhouse must be prevented.

With regard to life conditions of the plants it is also absolutely necessary, that the greenhouse is ventilated, and for this purpose there exist sophisticated control systems, which control the opening and closing of the ventilator doors of the greenhouse. According to a known system the shutters are infintely controllable, which means that the air passage varies from fully open to closed. An insect-net to be used for this purpose must consequently be able to cover the whole opening, but on the other hand at reduced opening should not be able to blow out through this. In order to prevent the opening the insect-net along its whole length and width has to be controlled, which can be carried out by means of wires, rods or the like, but also assumes that the net is prepared, i.e. is reinforced where the strains are largest. The net consequently is subjected to appreciable mechanical strains, and an important requirement is that the net can resist these stresses without the net meshes being deformed. These are dimensioned after the smallest occurring insect and even a moderate deformation of the net meshes entails that the net does not fulfil its function.

The ventilation in greenhouses is carried out by self draught, which means, that the insect-net air permeability must be maximum, at the same time as the free opening of the net meshes must be very small, with regard to the smallest ocurring insect (the area of the net mesh should be in the magnitude of 0,5×0,5 mm). Besides the yarn in the net shall have the required strength, which also sets limits. An additional very important criterion which has to be complied with is that the woven net is step secure, by which is meant that the fabric is deformation resistant against dislocation of both crossing thread systems of the fabric (the warp and the weft). The step security is a special problem when thin yarnes must be used, which is unavoidable for insect-nets for greenhouses, since the net does not give too large shade effect. A light loss of one percent namely also implies one percent fall in production.

Since the insect-net is exposed to direct sunlight, the yarn material has to be UV-stable. Even there the thickness of the yarn comes into play, the thinner the yarn the poorer is also their UV-stability. This demand also strongly limits the material choice.

The object of the invention is to provide an insect-net of type mentioned by of introduction, which fulfills the following criteria:

1. Good UV-stability, even in relationship to the slight yarn thickness;
2. High strength and long life-span;
3. Slight yarn thickness in relation to the free hole in the net mesh, i.e. smallest possible of the yarn covered area relatively the open area;
4. High air permeability (smallest possible pressure drop);
5. Step secure, ie. deformation resistant against dislocation of the crossing thread system of the fabric;
6. Drapeable or foldable, so that the insect-net occupies as small space as possible, when it is not used;
7. The reinforcements for receiving control means for control of the insect-net must neither open the net meshes nor diminish their air permeability;
8. Free of preparation, the insect-net shall be able to be manufactured without subsequent preparing, as that it directly fits for cooperation with the control means;
9. Easy to mount and
10. Shall be able to be manufactured in high production machines and thereby to a moderate price.
11. Dirt-repelling.

These tasks have according to the invention been solved by at least the yarns of one of the thread systems preferably the warp yarn, as well as the weft yarn is composed by mono filament yarn, and so called "hairy" yarn with thread ends protruding from this, for example spun yarn. In the warp or weft direction of the fabric at some the distance from each other control threads are inlaid, which are provided to by even intervals to form loops for receiving control means fixed at the shutter.

BRIEF DESCRIPTION OF THE DRAWINGS

The invention will be closer described below in an embodiment with reference to the enclosed drawings.

DETAILED DESCRIPTION OF THE INVENTION

Figure 1:
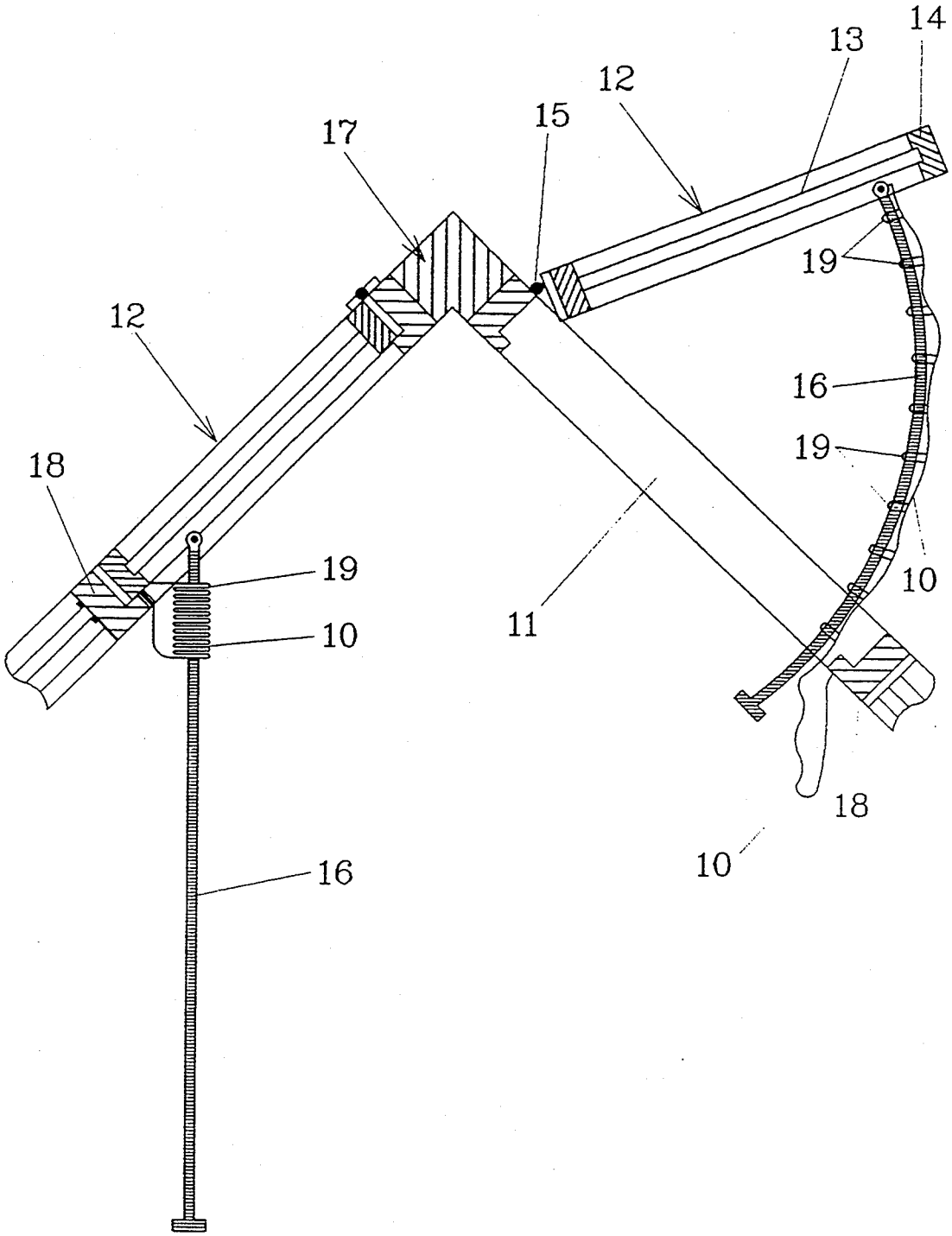
FIG. 1 discloses a section through the ridge of a greenhouse, provided with ventilator doors and an insect-net according to the invention.

FIG. 1 discloses an example of how in a greenhouse (17) an insect-net (10) is used according to the invention which is placed in the air passages (11) of the ventilator doors (12), and which consist of window-frames (14) with window pane (13) provided. Window frames (14) are pivotably mounted in their upper part about a hinge (15) and at their opposite end are provided with control bars (16) articulatedly connected at some distance from the bottom part of the window-frame. The purpose of the control bars (16) is to prevent the insect-net from blowing out through the window opening (11) or flutter in the opening, but the purpose of which is also that of controlling the insect-net folding on the inside of the greenhouse (17) when closing the ventilator door (12), such as is shown in the left the part of FIG. 1.

The insect-net (10) is with its bottom end attached to the window-frame (18) of the ventilator door (12) and with its upper end to bottom frame piece of the window-frame (14). The sectors which are generated by opening of the ventilator door at the end portions, are protected by means of insect-net gables in the same manner as the long sides.

Figure 2:
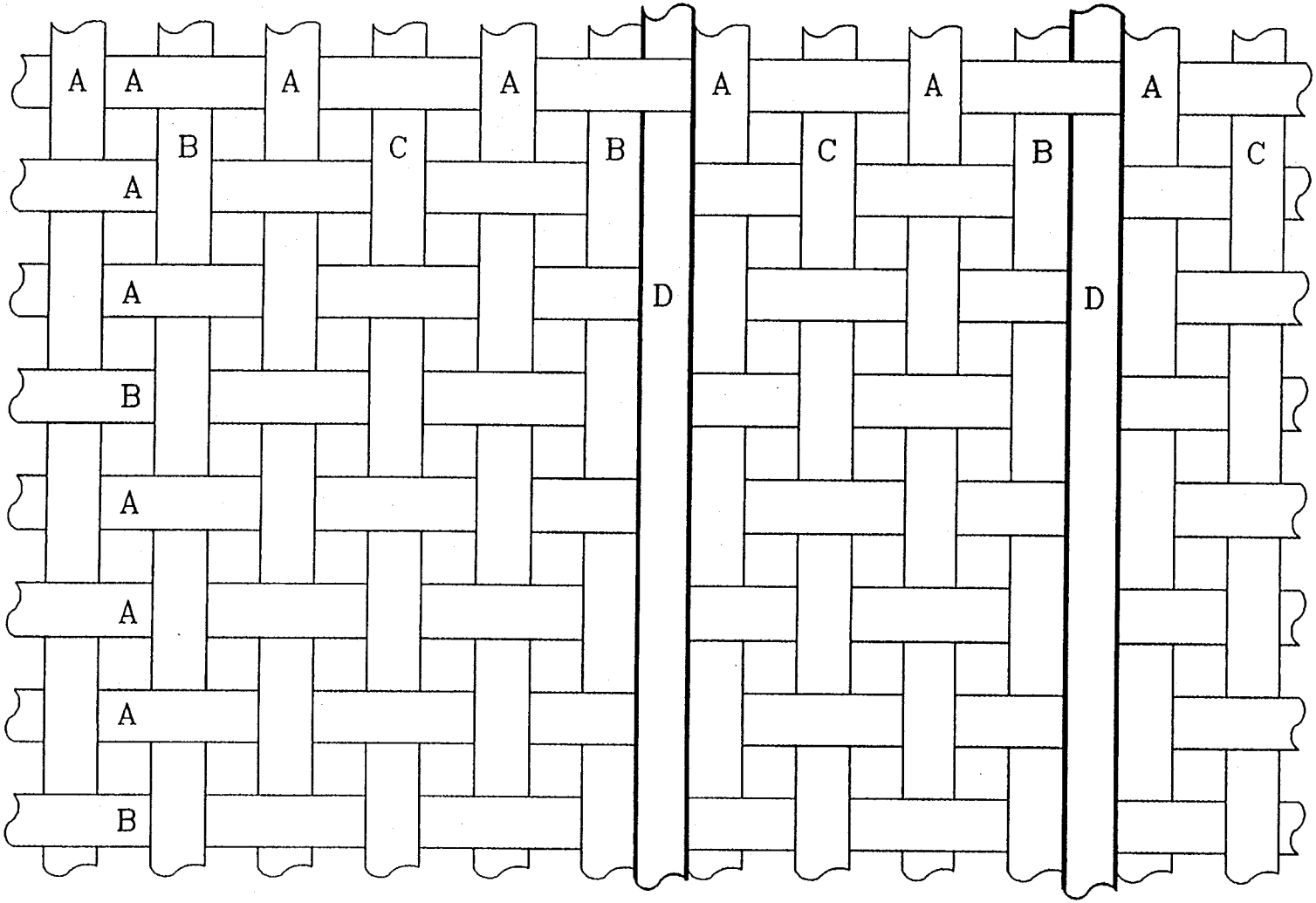
FIG. 2 discloses in enlarged scale a portion of an insect-fabric according to the invention.

An insect-net which fulfills all the requirements stated above and which is exposed to the mechanical strains as is evident of the embodiment shown in FIG. 1, conveniently consists of a number of yarns of different types and characteristics, and FIG. 2 discloses a portion of a fabric which fulfills all these requirements. The fabric is composed by a composition of mono filament yarn (A) and different types of "hairy" soft yarn (Was bled and B), i.e. yarn with thread ends protruding therefrom, for example spun yarn or blown yarn. As is evident of the FIGS. 2–4 the fabrics is designed such, that the mono filament yarns (A), which conveniently consist of UV-stabilized polyolefins, such as polyethylene or polypropylene, are relatively rigid and despite its slight diameter (0,18 mm) has a high strength. The mono filament yarns were used in the embodiment shown as a yarn skeleton, with yarn as well in the warp as in the weft direction and where every second weft yarn is a mono filament yarn (A) and every second a "hairy", soft yarn (B,C) and where three warp yarn in sequel is mono filament yarn (A) and every fourth warp yarn is a "hairy" soft yarn (B). Every second of the "hairy", soft weft yarns (C) has substantially smaller cross section and the folding direction of the insect-net is essentially parallel to the warp direction (C). In order to get the fabrics soft and drapeable, for example foldable, in the warp as well as in the weft direction are inlaid hairy, soft yarn (B), eg. a spun acrylic, with a relatively large diameter (0,30 mm), whereby is obtained in addition to the softness also provides a brake against step displacement. In order to further enhance the softness of the material and then particularly in the folding direction of the material are thin, hairy yarn (C) relatively loosely inlaid, (with a diameter of eg. 0,15 mm). The material in these hairy yarns is as well preferably acrylic, but can even consist of PVC, polyester or nylon. These yarns are as well UV-stabilized.

The conventional method to fasten the insect-net (10) to control bars (16) is either by means of hooks, which are hooked into the fabric and which by means of a loop shaped portion is displaceable along the control bars or by loop ribbons being sewn to the insect-net just in front of the control bars (16) and through which loops the control bars are thread. In the former case, the hooks will deform the net, so that so great openings are formed that insects can pass through these, while in the other case the air permeability of the insect-net is deteriorated.

Besides such an insect-net has to be prepared, i.e. loop strings must be sewn, which requires a manual operation which considerably rises the price of the net. According to the invention in the fabric warp and/or weft direction at some distance from each other control threads (D) have been inserted likewise of a hairy, but in relation to the rest very rough yarn, (for.example. 1 mm in diameter), and which control threads with even intervals form loops (19), through which the control bars (16) of the ventilator door (12) are thread.

Figure 3:
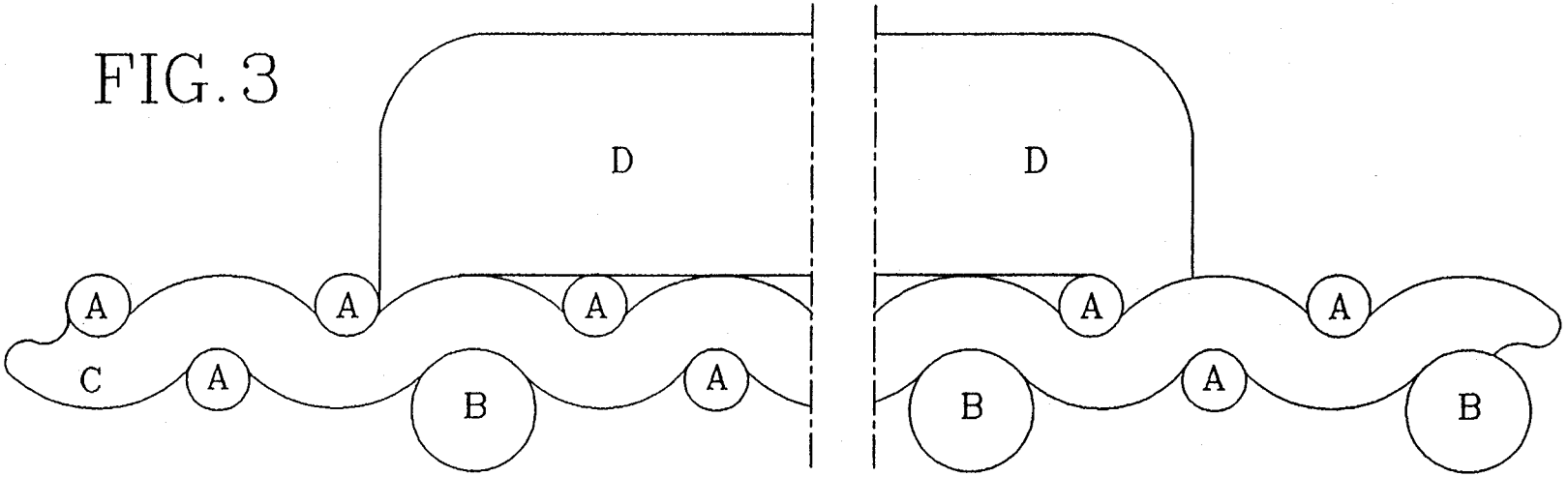
FIG. 3 discloses in strong magnification a warp section.
Figure 4:
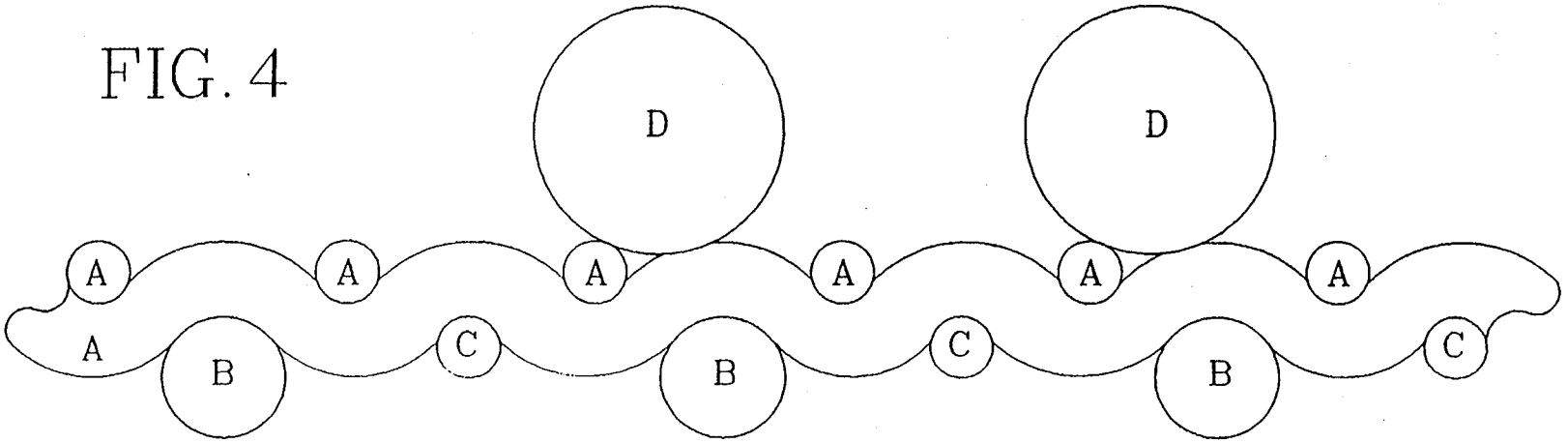
FIG. 4 a weft section through the insect-net according to FIG. 2.

As is evident from the FIGS. 2–4 a three shaft binding pattern has been used, but even other binding patterns are conceivable. The substantial thing is, that the net consists of a relatively rigid yarn skeleton, which gives rise to pressure points on the soft, hairy yarns (B and C), whereby a step secure fabric is obtained. The slight yarn thickness of the mono filament yarns (A) and the "hairy" yarns (C) entails, that the free hole of the yarn meshes is great in relationship to the yarn quantity contained in the fabrics, which gives high air permeability at maintained mesh size. The yarns B and C give the fabrics its softness and draping ability as well as prevent that the mono filament yarns can be dislocated so that a step secure fabric is obtained. By inlay in the fabrics of a special strong control thread (D), which with even intervals form loops (19) a ready-made fabric is obtained, which direct fits for cooperation with the control bars (16). The loops (19) are capable of absorbing the mechanical stresses, which the fabrics is exposed to at the opening and closing of the ventilator doors, but even the influence effected through weather and wind, so that elements of risk have been eliminated, which earlier gave rise to deformation of the net meshes. The insect-net fabric is also easy to mount, as it by simple operations directly can be applied to the ventilator doors of the greenhouse, by threading the loops (19) onto their control bars. The material choice and the binding method has entailed that the fabrics can be manufactured in high productive looms, which can produce very great quantities per time unit. The materials chosen in the yarns contained is dirt-repellent.

The invention is not limited to the embodiment described and and shown in the drawings, but several variations are conceivable within the scope of the claims.

We claim:

1. An insect net for screening off an air passage, said air passage being opened and closed with a shutter, said net comprising:

a thread system including a plurality warp yarns and a plurality weft yarns;

at least one monofilament yarn forming at least one of said yarns;

at least one hairy yarn forming at least one of said yarns;

at least one control thread interleaved with said monofilament yarn and said hairy yarn, said control thread forming at least one loop; and said shutters including a control means, wherein said control means is received in said loop.

2. The insect net of claim 1 wherein said weft yarns include a plurality of first and second weft yarns, said thread system alternating said first and second weft yarns, said first weft yarns are formed of said monofilament yarn and said second weft yarns are formed of said hairy yarn.

3. The insect net of claim 2 wherein said warp yarns include a first plurality of said warp yarns and a second warp yarn, said first warp yarns are formed of said monofilament yarn and said second warp yarn is formed of said hairy yarn, said first plurality of warp yarns and second warp yarn being adjacent to one another.

4. The insect net of claim 3 wherein said first plurality of warp yarns comprises three warp yarns.

5. The insect net of claim 4 wherein said hairy yarn comprises a first hairy yarn and a second hairy yarn, said plurality of said second weft yarns being formed of alternating said first and said second hairy yarns.

6. The insect net of claim 5 wherein said warp yarn is said first hairy yarn.

7. The insect net of claim 6 wherein said second hairy yarn has a substantially smaller cross section, wherein the folding direction of said insect net is parallel to the warp direction.

8. The insect net of claim 7 wherein said control threads are formed of hairy soft yarn, said control threads having a greater thickness then said first and second hairy yarns.

9. The insect net of claim 8 wherein said net is thermo fixed.

10. The insect net of claim 1 wherein said monofilament yarn is a uv stabilized polyolefin.

11. The insect net of claim 10 wherein said monofilament yarn is formed of a material selected from the group of polyethylene and polypropylene.

12. The insect net of claim 1 wherein said hairy yarn is formed of a material selected from the group of acrylic, pvc, polyester and nylon.

* * * * *